US005579845A

United States Patent [19]

Jansen et al.

[11] Patent Number: 5,579,845

[45] Date of Patent: Dec. 3, 1996

[54] METHOD FOR IMPROVED WATER WELL PRODUCTION

[75] Inventors: John R. Jansen; Robert W. Taylor, both of West Bend, Wis.; William C. Frazier, W. 175 S. 6827 East Dr., Muskego, Wis. 53150

[73] Assignee: William C. Frazier, Muskego, Wis.

[21] Appl. No.: 385,184

[22] Filed: Feb. 7, 1995

[51] Int. Cl.[6] ..... E21B 43/00

[52] U.S. Cl. ..... 166/299; 166/305.1

[58] Field of Search ..... 166/177.5, 177.6, 166/177.8, 299, 63, 305.1, 307

[56] References Cited

U.S. PATENT DOCUMENTS 3,702,635 11/1972 Farr ..... 166/299

5,297,631 3/1994 Gipson ..... 166/299

*Primary Examiner*—William P. Neuder

*Attorney, Agent, or Firm*—Reinhart, Boerner, Van Deuren, Norris & Rieselbach, s.c.

[57] ABSTRACT

A non-destructive method for stimulating, refurbishing, or otherwise increasing production from water wells, using pressure waveforms and mass displacement within the well bore volume. The non-destructive methods are useful in a variety of water production contexts and can be modified downhole to meet specific performance requirements.

20 Claims, 3 Drawing Sheets

METHOD FOR IMPROVED WATER WELL PRODUCTION

BACKGROUND OF THE INVENTION

The present invention relates generally to water well production and, more particularly, to methods for increasing the production of water wells.

Currently, water well bores, bore holes, screens, casings and related downhole apparatus, as well as the geological formations surrounding them, are cleaned, refurbished or otherwise stimulated using an explosive charge. Well owners have traditionally held a guarded view with respect to use of dynamite, primacord, or a similar-acting explosive material, given the high potential for effect beyond the immediate concern. This approach is shared in situations involving wells owned, managed, or operated by municipalities or others who, in a similar fashion, hold the public trust. The uncontrollable nature of such materials often creates regulatory and liability concerns far beyond any attainable benefit.

Aside from the more obvious legal implications, the use of dynamite or related explosives is associated with a number of significant operational and overall efficiency concerns. Foremost among these is the estimation involved in choosing a charge equivalent to the force required to accomplish a desired goal. An over-estimation can result in unwanted and expensive well destruction, not to mention personal injury and other property damage. An initial charge estimated too low will necessitate time-consuming reloadings and repeated firings. The amplitude and frequency of energy released from the gas created will be dependent upon the charge selected. Invariably, the charge will be inappropriate for the stimulation required. Use of explosives by trial and error is ill-advised.

In summary, a considerable number of drawbacks and deficiencies exist in the art relating to water well production and stimulation. There is a need for a non-destructive and controllable method for increasing water well production.

OBJECTS OF THE INVENTION

It is an object of this invention to provide a method for increasing water well production, overcoming the problems of the prior art, including those mentioned above.

It is an object of this invention to provide a method for improving and/or increasing water well production through use of percussive waveforms and mass displacement in a non-destructive manner.

It is an object of this invention to provide a method for stimulating water wells and surrounding geological formations through use of percussive waveforms which can be repeatedly generated as desired without withdrawal, removal, or reloading the waveform generator outside the well.

It is another object of this invention to provide a method for refurbishing water wells with downhole control and adjustment of waveform frequencies and energy content.

It is an object of the present invention to improve water well production through the engineering and design of waveform frequency and amplitude parameters to meet specific performance characteristics.

It is an object of this invention to provide a method for water well stimulation having higher rates of productivity.

It is an object of this invention to increase water well production through methods which provide field reliability and reproducibility.

These and other important objects, features and advantages of the present invention will be readily apparent from the following description of the preferred embodiments thereof, taken in conjunction with the accompanying examples and figures.

SUMMARY OF THE INVENTION

Figure 2A:
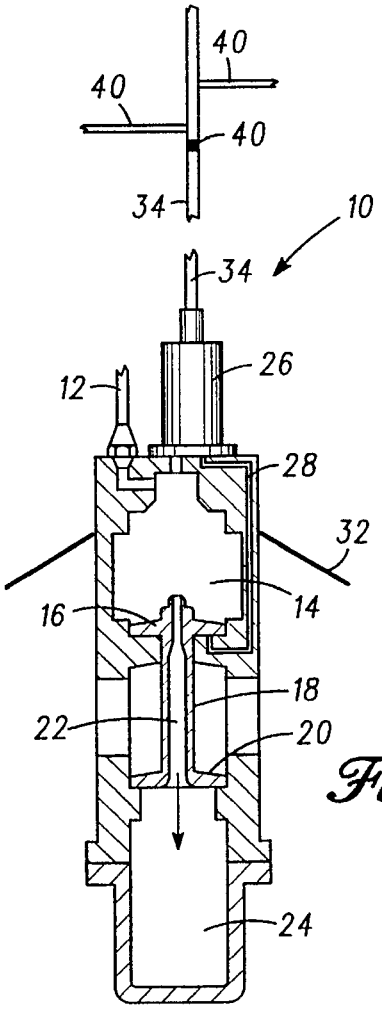
FIGS. 2A and 2B are partial cross-sectional views of a preferred percussive gas venting apparatus for use in conjunction and accordance with the present invention.

This invention is a non-destructive method for increasing and/or stimulating water well production. The invention overcomes certain well-known problems and deficiencies, including those outlined above.

In part, the present invention is a method of stimulating water well production, including: (1) providing a water well with a bore volume; (2) inserting into the bore volume means for generating propagating pressure waveforms and mass displacement through the bore volume; (3) activating the generation means whereby impediments to well production are removed through interaction with the waveforms; and (4) adjusting the frequency of the activation and amplitude of the waveforms generated. The waveform generation means can include, but is not limited to, at least one percussive gas venting apparatus, at least one electrical arc generator, and combinations thereof.

In preferred embodiments, the waveform generation means is a percussive gas venting apparatus. The apparatus is activated to provide about 1–15,000 cubic inches of gas at a pressure of about 250–10,000 psi. In highly preferred embodiments of this inventive method, the apparatus provides about 10–1,000 cubic inches of gas at a pressure of about 500–3,000 psi. In preferred embodiments, the apparatus is activated at intervals of 1–120 seconds. In highly preferred embodiments, the interval of activation is about 3–100 seconds.

Alternatively, an electrical arc generator can be utilized to generate the pressure waveforms and mass displacement. Preferably, the arc generator is activated at intervals of 2–10 seconds. In other embodiments of invention, the wave generation means comprises two or more gas venting apparatus, or a combination of at least one gas venting apparatus and at least one electrical arc generator.

In part, the present invention is a non-destructive method of mineral, biological, and scale removal from the pump, casing, and screen apparatus and geological structure surrounding a water well, including: (1) inserting means for generating percussive energy into the bore of a water well; (2) initiating percussive impact within the well bore; (3) monitoring the removal of mineral, biological and/or scale deposits; and (4) adjusting the percussive energy whereby the mechanical action of the energy propagating within the bore and surrounding geological structure enhances apparatus performance and improves water production. The energy generation means is selected from the group consisting of at least one percussive gas venting apparatus, at least one electrical arc generator, and combinations thereof. In preferred embodiments, the energy generation means is a percussive gas venting apparatus which includes a high pressure gas gun. In highly preferred embodiments, the gas gun further includes a deflector to focus the percussive energy generated. Likewise, in highly preferred embodiments, the air gun includes at least one hold-off member to position the gas gun within the well bore.

A preferred percussive gas venting apparatus is initiated to provide the percussive impact of about 1–15,000 cubic inches of gas at a pressure of about 50–1,000 psi. In highly preferred embodiments of this method, a preferred gas gun provides about 10–1,000 cubic inches of gas at a pressure of about 500–3,000 psi. Likewise, in highly preferred embodiments, the percussive impact is initiated at intervals of about 3–100 second.

In part, the present invention is a non-destructive method of rehabilitating a water well by removing impediments to water production, including: (1) lowering into the bore of a water well means for generating percussive energy, the generating means including a high pressure gas gun; (2) initiating percussive impact within the well bore; (3) monitoring the removal of mineral, biological, and/or scale and related production impediments; and (4) adjusting the percussive energy whereby the mechanical action of the energy propagating within the well bore improves water production. In preferred embodiments, the gas gun includes a deflector to focus the energy generated.

As discussed above, the benefits associated with use of a non-explosive, non-destructive source of pressure waveforms and/or mass displacement include downhole control and increased production rate. Through use of a percussive gas venting apparatus, the propagated energy is directly related to the volume of the air vented and the pressure at which it is vented. Both parameters and their effect on the well system can be controlled, monitored, and adjusted without withdrawing the apparatus from the well bore. To that effect, water well production can be stimulated, refurbished, and/or increased through the isolated or repetitious impact of the percussive energy on pumping, casing, and screen apparatus, as well as the geological formation surrounding the well bore. With respect to the latter situation, the pressure waveforms and mass displacement of the water volume can be directed to clean and/or remove scale from the formations surrounding an uncased well bore. Likewise, the surrounding geological formation of sand and gravel pack wells can be modified to increase production. The invention can also be used to dislodge geological bridges across the well bore and, in a similar fashion aid in the extraction of pumps, lodged drilling tools, casings, and screens.

Generally, the displacement of the aqueous medium mass is best accomplished by the rapid deployment of pressure waveforms. Rapid venting at high pressure provides the energy required to remove impediments and increase water production. As described above, a percussive gas venting apparatus can be used effectively in this manner. Such apparatus include, without limitation, means to provide volumes of air downhole and vent it rapidly at high pressure. Gas compressors, tanks of pressurized gas, and other sources of gas volume can be used in conjunction with accessory equipment for the rapid deployment of the gas within the well bore and/or bore. Without limiting the present invention, venting apparatus include a high pressure gas gun coupled to a supply of pressurized gas. As described below, and well known in the art, one such gas gun is available under the BOLT trademark, from Bolt Technology Corporation. Equivalent gas guns, pressurized gas supplies, conduits, and related apparatus may be used with equal effect, without limiting the scope of the present invention.

Alternatively, alone or in combination with a gas gun or its venting equivalent, electrical arc generators can be used to effect a method of this invention. Such generators, commonly referred to as sparkers, operate in part through the vaporization of fluid contacting the generator. With respect to the present invention, an electrical source produces sufficient heat to generate steam, the expansion of which creates pressure waveforms and displaces the water mass throughout the bore volume. Sparkers are available from a number of sources well known to those skilled in the art. The waveform frequencies obtained therefrom are generally higher than those obtainable from high pressure gas guns. While empirical studies of band width and center frequencies are generally unavailable, the pulse obtained from a high pressurized gas gun is typically in the 50–200 Hz band, with sparkers in the 200 Hz to 1 KHz band. In practical terms, when used alone, sparkers can be effective in breaking up brittle scale. They can also be used in conjunction with one or more high pressured gas gun to provide a broad frequency spectrum specifically designed or engineered to achieve a target rate or volume of production.

With respect to use of preferred gas guns of the present method, the volume of gas and the pressure at which it is vented within the bore volume is limited only by the mechanical and practical considerations associated with the construction, design, and deployment of such equipment. For various efforts associated with water well maintenance and/or stimulation, volumes of 10–1,000 cubic inches of gas released at pressures of about 500–3,000 psi are sufficient. However, where certain use applications require higher volumes and/or pressures, such as in situations involving impeding structural or apparatus bridges, larger capacity guns can be provided by adjusting the chamber, size and effective air pressure. Using a plurality of gas guns permits waveform propagation and mass displacement to be tailored with respect to frequency and related wave parameters, either through sequential or intermittent activation, with or without the creation of standing waves. Preferably, and in conjunction with most use applications, the method of this invention contemplates waveform generation at intervals of about 1—120 seconds and, most preferably, at 3–100 seconds when a high pressured gas gun is utilized. Other useful waveform generators are capable of providing pressure waveforms at a faster rate and can thereby be used alone or in conjunction with the preferred gas guns to provide a frequency spectrum. For example, the sparkers described above can be activated at a rate as frequently as once per second. In preferred embodiments of the present invention, the activation time interval is about 2–10 seconds. With any venting apparatus used herewith, any limitation on impediment removal can be offset by repeated activation without withdrawal of the apparatus from the well bore. The necessity of adjustment and/or repeated activations can be gauged through use of monitoring equipment, including without limitation video cameras and calipers to track deviations in well bore diameter.

DETAILED DESCRIPTION OF PREFERRED EMBODIMENTS

Figure 1:
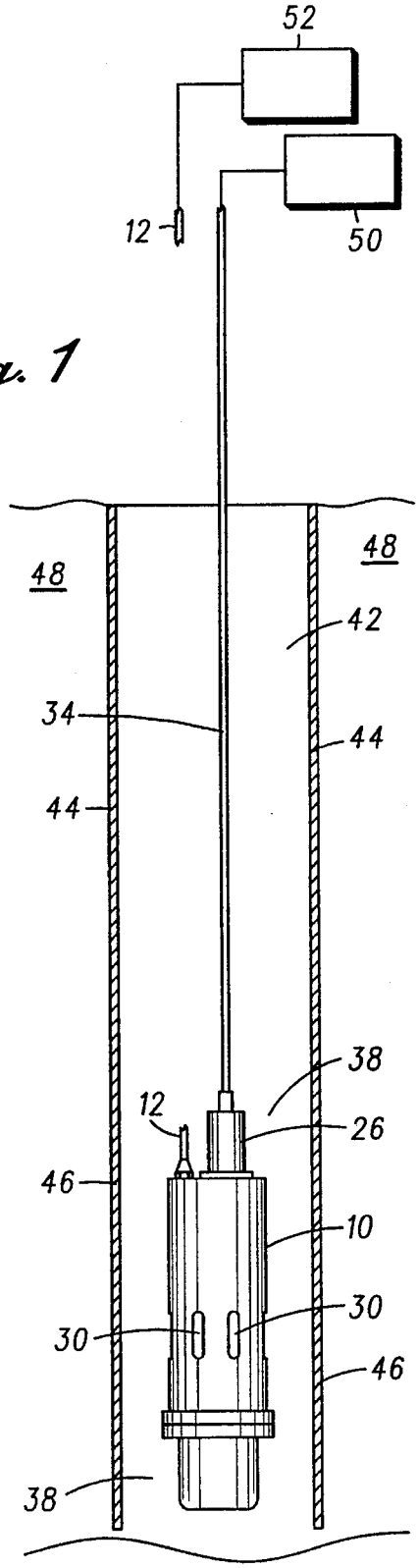
FIG. 1 is a schematic partial cross-sectional view of a water well of the type with which the present invention can be used.

FIG. 1 schematically represents a partial cross-sectional view of water well/well bore 42, within which is positioned gas gun 10, a preferred percussive venting apparatus of the present invention. With reference to FIG. 2A, pressurized gas enters gun 10 through gas intake 12. The gas passes into upper chamber 14, across which is fitted the upper portion of shuttle 18 consisting of triggering piston 16. The lower portion of shuttle 18 comprises firing piston 20 which defines the upper limit of lower chamber 24. Shuttle passage 22 allows passage of gas from upper chamber 14 to lower chamber 24. Upon gas entry, the same pressure is developed in both upper chamber 14 and lower chamber 24. However, the surface area of triggering piston 16 is sufficiently greater than the surface area of firing piston 20, such that the net downward force on triggering piston 16 causes shuttle 18 to move downward until the surface of firing piston 20 contacts the perimeter of lower chamber 24.

Figure 2B:
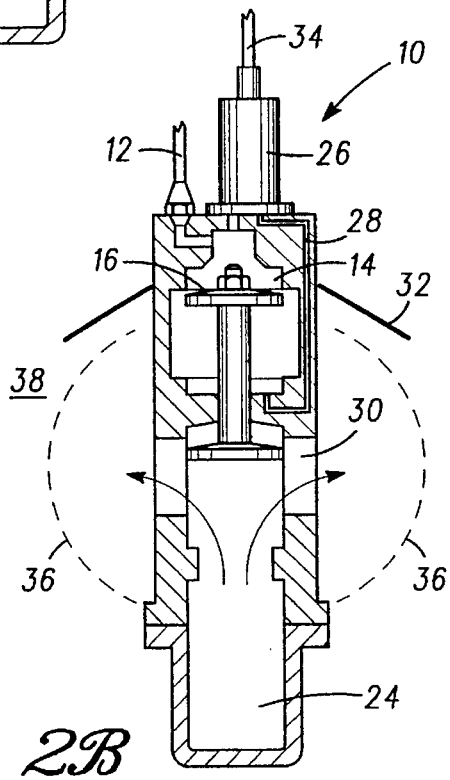

With reference to FIG. 2B, initiation of air gun 10 includes activation of solenoid 26 and injection of high pressure gas between triggering piston 16 and upper chamber 14 through chamber passage 28. The sudden introduction of gas through solenoid 26 disrupts the equilibrium state of gun 10, causing shuttle 18 to move upward at a high velocity. Passage of firing piston 20 past ports 30 rapidly releases the gaseous volume of lower chamber 24. The electrical current operating solenoid 26 is provided through conduit 34. Waveforms 36 generated from the rapid, high pressure release of gas from lower chamber 24 propagate through the mass of water medium 38 within well bore 42.

As shown in FIGS. 2A and 2B, preferred embodiments of gas guns of the type utilized in accordance with the present invention can include one or more deflectors for the purpose of concentrating or focusing the percussive waveforms on a specific target or area within the well bore. As shown in FIGS. 2A and 2B, deflectors 32 are secured to gas gun 10 in a manner sufficient to withstand the waveform impact and permit them to function according to design. Deflectors or focusing members of the type shown in FIGS. 2A and 2B are especially useful in the removal of scale and mineral deposits from screened wells.

Likewise, as shown in FIGS. 2A and 2B, hold off members 40 are secured to conduit 34 in such a way as to position gas gun 10 within a well bore. As shown in the referenced figures, hold off members 40 can be dimensioned, arranged and configured symmetrically to centrally position gas gun 10. Alternatively, hold off members 40 can be dimensioned and arranged to decentralize gas gun 10 within a well bore. Without limiting the scope of this invention, hold off members 40 can also be situated in a stationary fashion within the well bore volume to permit vertical movement of gas gun 10 before and after operation, or between activations.

As shown schematically in FIG. 1, gas gun 10 is positioned within well bore/volume 42. The water well system of FIG. 1 includes casing 44 and casing perforations 46. With equal effect, however, the methods of this invention can be utilized in conjunction with water wells lacking a casing apparatus, such that the percussive energy initiated impacts geological structure formation 48, directly. As referenced above, gas gun 10 operates in conjunction with gas source 52, and solenoid 26 operates in conjunction with electrical source 50, which can be provided separately or in conjunction with gas source 52.

Figure 3:
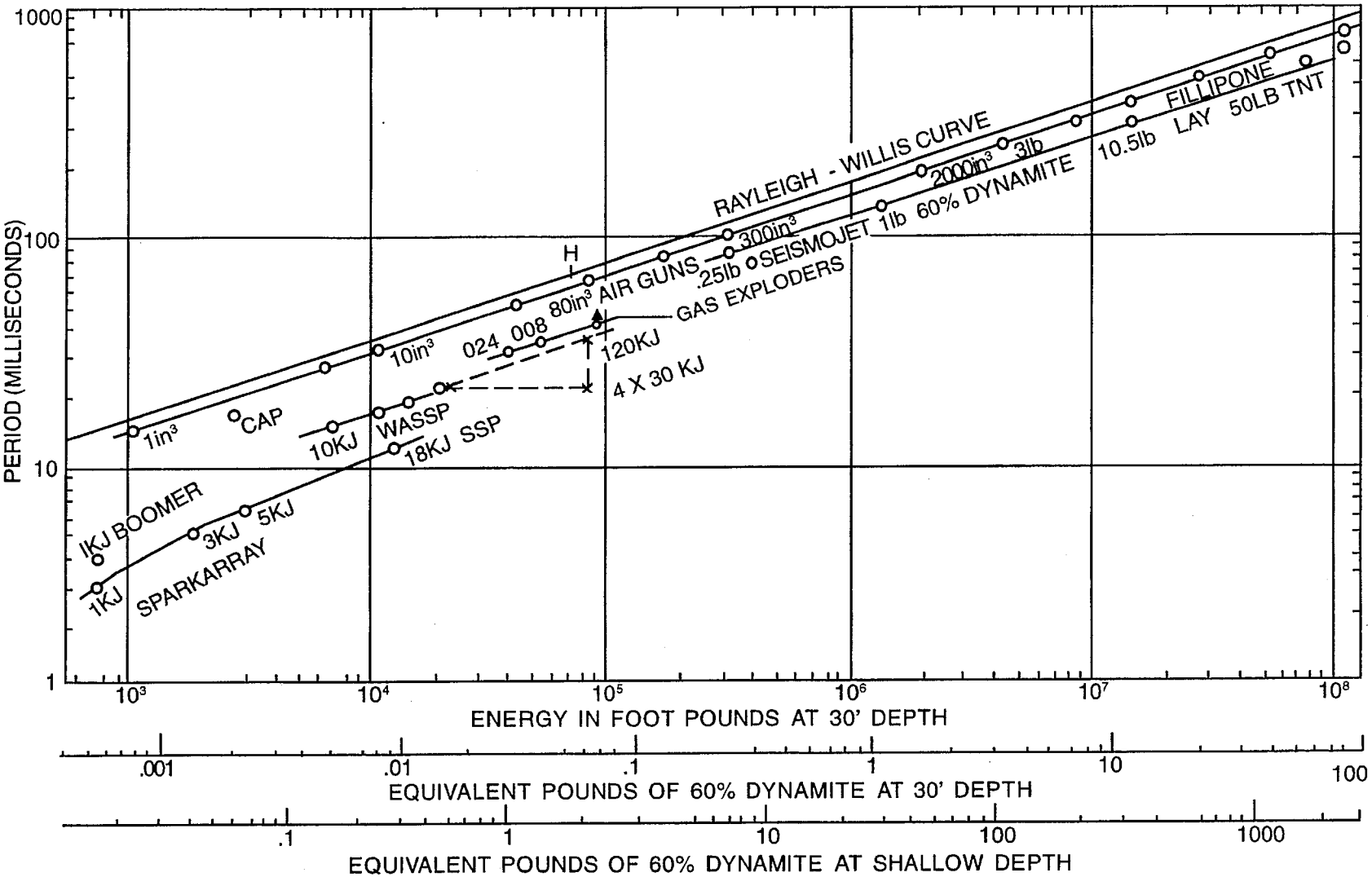
FIG. 3 is a graphic presentation relating and comparing energies and available energy sources.
Figure 4:
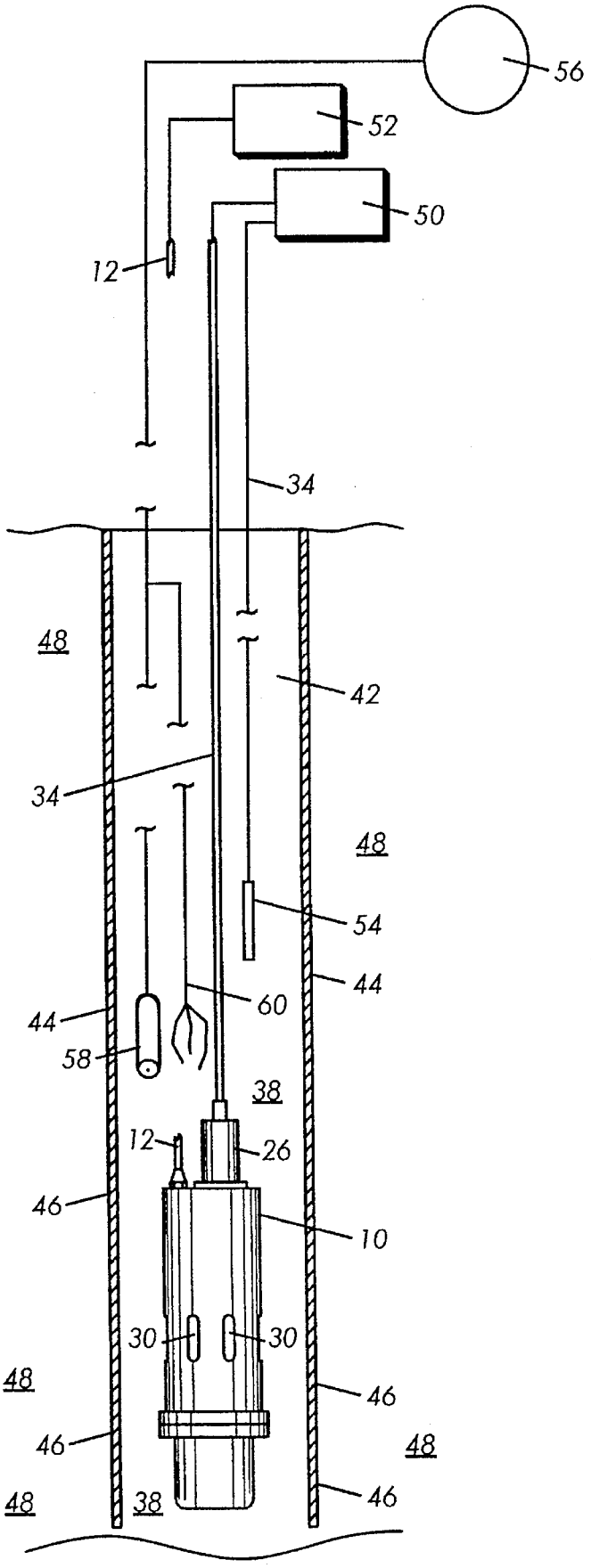
FIG. 4 is a schematic partial cross-sectional view of a water well of the type with which the present invention can be used, showing in particular an electrical arc generator (54) which can be used alone or in combination with a gas gun (10), as well as video equipment (58) and bore diameter measuring equipment (60), each of which can be used alone or in combination with the other to monitor (56) the effect of waveforms and/or percussive energy without withdrawing apparatus from the well base.

In FIG. 3, the energy generated by preferred gas guns of the present invention is compared to dynamite charges of the prior art. Based on the empirical data shown in FIG. 3, a 10 cubic inch air gun is equivalent in energy to 0.01 pounds of 60% dynamite; and an 80 cubic inch gas gun is equivalent to about 0.1 pounds of 60% dynamite. Downhole guns with a capacity of 1,000 cubic inches provide energy equivalent to about 1.0 pounds of 60% dynamite. FIG. 3 also compares the energy provided by a preferred electrical arc generator. As seen therein, sparkers provide energy approximately equal to a 5 cubic inch gas gun or about 0.003 pounds of 60% dynamite. The correlations provided in FIG. 3 confirm, on the basis of available and empirical data, that the non-destructive energy available through use of present invention is equivalent in terms of magnitude and volume to the energy available from explosive sources of the prior art.

While the principles of this invention have been described in connection with specific embodiments, it should be understood clearly that these descriptions are made only by way of example and are not intended to limit the scope of the invention, in any manner. For example, using techniques well known to those skilled in the art, the percussive impact of the waveform energy can be used in conjunction with injection of various fluids, solvents, and reagents suitable for use in the presence of water sources to increase mechanical agitation. Furthermore, steam can be utilized as a compressed gas at temperatures and contact times beyond the tolerable limits of biologicals, which are then dislodged by percussive impact. The various combinations of waveform energies can be utilized alone or in conjunction one with the other, without deviating from the invention disclosed herein. Specific waveform frequencies, amplitudes, and related parameters are dependent, in part, upon the specific well bore, pumping, casing and screening apparatus, as well as the particular type of production impediment to be removed. Likewise, the waveforms used are limited only by various practical considerations and mechanical and equipment tolerances relating to the high pressure, rapid deployment of such waveforms. In addition, the methods of this invention can be used with gravel wall, screened wells, screened wells in consolidated formations, and with steel or iron casings—all without depth limitation. Other advantages are features of the invention will become apparent from the claims hereinafter, with the scope of the claims determined by the reasonable equivalents as understood by those skilled in the art.

What is claimed is:

1. A method of stimulating water well production, comprising:

providing a water well, said well having a bore volume;

inserting into said bore volume means for generating pressure waveforms and mass displacement through said bore volume, said waveform generation means selected from the group consisting of at least one percussive gas venting apparatus, at least one electrical arc generator, and combinations thereof;

activating said generation means whereby impediments to well production are removed through interaction with said waveforms;

monitoring the effect of said waveforms using video equipment, bore diameter measuring equipment, or a combination of said equipment; and adjusting the frequency and amplitude of waveforms generated to meet well performance characteristics.

2. The method as defined in claim 1 wherein said waveform generation means is one percussive gas venting apparatus.

3. The method as defined in claim 2 where in said apparatus is activated to provide about 1–15,000 cubic inches of gas at a pressure of about 250–10,000 psi.

4. The method as defined in claim 3 wherein said apparatus provides about 10–1,000 cubic inches of gas.

5. The method as defined in claim 4 wherein said gas is provided at a pressure of about 500–3,000 psi.

6. The method as defined in claim 3 wherein said apparatus is activated at intervals of about 1–120 seconds.

7. The method as defined in claim 6 wherein said interval of activation is about 3–100 seconds.

8. The method as defined in claim 1 wherein said waveform generation means is an electrical arc generator.

9. The method as defined in claim 8 wherein said generator is activated at intervals of about 2–10 seconds.

10. The method as defined in claim 1 wherein said waveform generation means is a plurality of gas venting apparatus.

11. The method as defined in claim 1 wherein said generation means is a combination of at least one gas venting apparatus and at least one electrical arc generator.

12. A non-destructive method of mineral, biological and scale removal from the pumping, casing, and screen apparatus and geological structure of a water well, comprising:

inserting into the bore of a water well means for generating percussive energy, said percussive energy generation means selected from the group consisting of at least one percussive gas venting apparatus, at least one electrical arc generator, and a combination thereof;

initiating percussive impact within the well bore;

monitoring said removal and the effect of said percussive energy using video equipment, bore diameter measuring equipment, or a combination of said equipment; and adjusting the frequency of said percussive energy whereby the mechanical action of said energy propagating within said bore and geological structure enhances apparatus performance and improves water production such that well performance characteristics are met as a result of said removal.

13. The method as defined in claim 12 wherein said energy generation means is a percussive gas venting apparatus, said apparatus including a high pressure gas gun.

14. The method as defined in claim 13 wherein said gas gun further includes a deflector to focus said energy.

15. The method as defined in claim 13 further including at least one hold-off member to position said gas gun within the well bore.

16. A method as defined in claim 13 wherein said percussive impact of said gas gun is initiated to provide about 1–15,000 cubic inches of gas at a pressure of about 250–10,000 psi.

17. The method as defined in claim 16 wherein said gas gun provides about 10–1,000 cubic inches of gas at a pressure of about 500–3,000 psi.

18. The method as defined in claim 13 wherein said percussive impact is initiated at intervals of about 3–100 seconds.

19. A non-destructive method of rehabilitating a water well by removing impediments to water production, comprising:

lowering into the bore of a water well means for generating percussive energy, said generating means selected from the group consisting of at least one high pressure gas gun, at least one electrical arc generator and combinations thereof;

initiating percussive impact with in the well bore;

monitoring said removal and the effect of said percussive energy using video equipment, bore diameter measuring equipment, or a combination of said equipment; and adjusting said percussive energy whereby the mechanical action of said energy propagating within said bore improves water production such that well performance characteristics are met.

20. The method as defined in claim 19 wherein said gas gun further includes a deflector to focus said energy.

* * * * *